United States Patent [19]

Carter

[11] 4,134,565

[45] Jan. 16, 1979

[54] ADJUSTABLE SEAT ASSEMBLY

[76] Inventor: James R. Carter, 9001 Lakeridge Dr., Louisville, Ky. 40272

[21] Appl. No.: 816,590

[22] Filed: Jul. 18, 1977

[51] Int. Cl.[2] ..... A47C 3/00

[52] U.S. Cl. ..... 248/285; 248/415; 248/345

[58] Field of Search ..... 248/285, 161, 418, 241, 248/354 P, 415; 297/345

[56] References Cited

U.S. PATENT DOCUMENTS

| | | | |
|---|---|---|---|
| 320,916 | 6/1885 | Dunlap | 248/415 |
| 431,803 | 7/1890 | Cunningham et al. | 248/415 X |
| 1,114,896 | 10/1914 | MacRae | 297/345 X |
| 1,297,802 | 3/1919 | Dambruch | 248/415 |
| 1,626,832 | 5/1927 | Huckel | 248/418 |
| 2,293,144 | 8/1942 | Jones | 297/345 X |
| 3,873,054 | 3/1975 | McKee et al. | 248/418 X |
| 3,960,406 | 6/1976 | Buker | 297/345 |
| 4,014,507 | 3/1977 | Swenson | 248/354 P |

*Primary Examiner*—Roy D. Frazier
*Assistant Examiner*—Peter A. Aschenbrenner
*Attorney, Agent, or Firm*—Charles G. Lamb

[57] ABSTRACT

An adjustable seat, particularly for locomotive cabs, the adjustable seat having a mounting assembly for mounting a seat member therein, the mounting assembly providing means for vertical adjustment and rotatable movement of the seat member. The mounting assembly is adjustably attached to support means and generally includes a tubular member with a socket therein to receive the seat member, the socket being defined by upper inner walls of the tubular member with an inwardly extending shoulder portion at a preselected position therein with a cylindrical trunnion bearing insert resting upon the shoulder, the seat member having a seat trunnion resting upon the insert.

5 Claims, 1 Drawing Figure

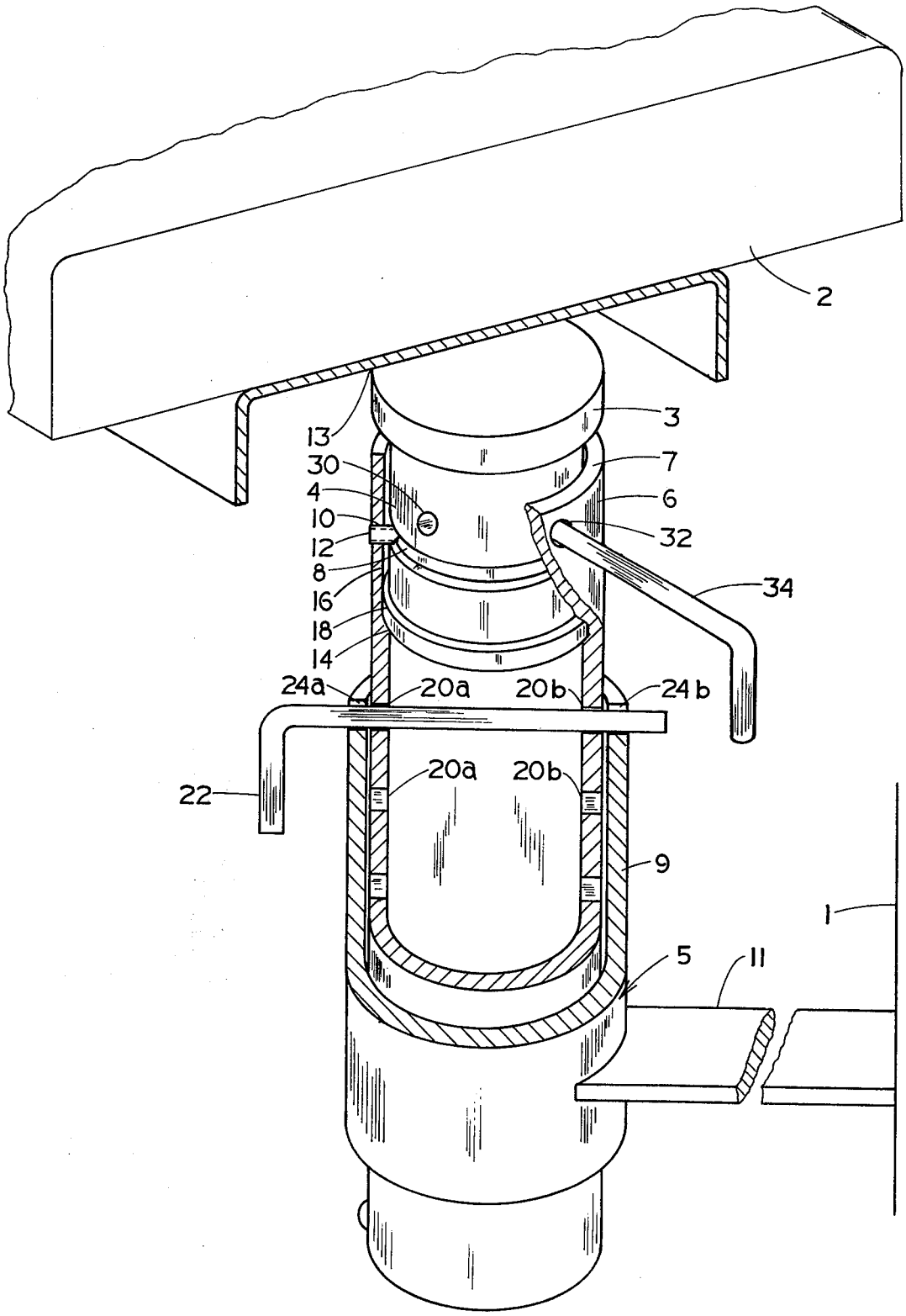
2
3
13
30
7
4
6
10
32
12
8
34
16
18
14
24a
20a
20b
24b
22
20a
20b
9
1
5
11

ADJUSTABLE SEAT ASSEMBLY

BACKGROUND OF THE INVENTION (1) Field of the Invention

This invention relates to an adjustable seat and more particularly relates to a mounting assembly for a seat member.

(2) Description of the Prior Art

In locomotive cabs, seats are generally provided for the engineer or other operators of the locomotive. These seats are generally adaptable for vertical adjustment as well as rotatable adjustment in order to assist the engineer or operator in carrying out the functions of his job in a comfortable position. The most commonly used seat and mounting assembly is one wherein a mounting assembly is secured to an inner side wall of a locomotive cab, the mounting assembly having a first vertically extending tubular member which is telescopically received by a second tubular member which is attached to a horizontally extending support member attached to the side wall of the cab. The first tubular member is provided with a socket therein, the socket being prepared by machining the inner wall of the first tubular member to a preselected diameter and depth to receive a seat trunnion therein. The first tubular member is provided with an upper edge machined to receive an outwardly extending flange on the upper extremity of the seat trunnion, the flange bearing against the upper edge of the tubular member. Thus, rotational movement of the seat causes wear between the trunnion flange and the upper machined edge of the tubular member thereby requiring replacement in relative short periods of time.

SUMMARY OF THE INVENTION

In the present invention, it is recognized that it is desirable to provide an adjustable seat assembly, particularly for locomotive cabs, which is inexpensive, easy to install, and durable over a relatively long period of time.

The present invention advantageously provides a straightforward arrangement for a seat assembly, particularly for locomotive cabs. The present invention further provides a tubular mounting assembly for rotatable seat members which reduces wear between a rotating seat trunnion and a stationarily mounted tube member which receives the seat trunnion therein.

Various other features of the present invention will become obvious to those skilled in the art upon reading the disclosure set forth hereinafter.

More particularly the present invention provides an adjustable seat comprising: mounting means secured to a wall; a vertically extending tubular member adjustably mounted to the mounting means, the tubular member having a socket therein, the socket being defined by upper inner walls of the tubular member with an inwardly extending shoulder at a preselected position therein; a cylindrical trunnion bearing insert resting upon the shoulder; a vertically extending seat trunnion received by the socket, the seat trunnion resting upon the insert; and, a seat member attached to the seat trunnion.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the drawing:

The FIGURE is a perspective view, partially cutaway, of one preferred seat assembly of the present invention.

DESCRIPTION OF THE PREFERRED EMBODIMENT

In the FIGURE, an adjustable seat 2, particularly for a locomotive cab, is mounted onto a side wall 1 of a locomotive. The means for mounting the seat 2 includes a tubular member 6 which is adjustably received in telescoping relation in a vertical position (to be discussed hereinafter) in a mounting assembly 5. Mounting assembly 5 includes a vertically extending tube 9 which is welded to a horizontally extending seat assembly support 11, support 11 being attached to side wall 1 by any known means, such as welding, bolting or the like, or may be slidably attached to a slide rail on the wall 1.

In the FIGURE the seat member 2 is provided with a seat trunnion 4 weldably attached as at 13 to the underside thereof and received by a tubular member 6. The trunnion 4 and the tubular member 6 are provided with means for locking the trunnion in the member 6 for anti-theft protection. In the anti-theft locking position, the seat trunnion 4 is provided with a groove 8 which is disposed for alignment with threaded aperture 10 which extends through the wall of the tubular member 6. A set screw 12 is received by the aperture 10 and the groove 8, the screw 12 being disposed within the groove 8 with a spacing between the end of the screw 12 and the inner wall of groove 8 so that upon rotation of the trunnion 4 the screw 12 does not rub against the walls of the groove 8. The screw 12 is usually fixedly attached to the tubular member 4 so that removal is difficult, thereby providing in combination with the groove 8 anti-theft protection.

Trunnion 4 and tubular member 6 are further provided with means for setting the seat at a plurality of rotatable positions, the trunnion 4 being provided with a plurality of apertures 30 therein at preselected positions therearound. In the preferred trunnion four apertures 30 are provided, only two being shown, with the spacing between the apertures being 90° with respect to adjacent apertures. An aperture 32 is provided in tubular member 6 for alignment with apertures 30, apertures 32 and 30 receiving a locking pin 34 therethrough thereby positioning the seat at a preselected rotatable position.

The tubular member 6 is provided with a shoulder 14 at a preselected position therein. Shoulder 14 and the inner walls 16 of the member 6 define a socket for receiving the seat trunnion 4 therein. Resting upon the shoulder 14 is a cylindrical trunnion bearing insert 18, insert 18 generally having an appropriate adhesive on the outer edge thereof for attaching to the shoulder 14. However, it is realized that the insert 18 may be welded, press-fitted, or inserted into the socket by any other means without departing from the scope and spirit of the present invention. Insert 18 receives the trunnion 4 thereon, trunnion 4 rotatably bearing upon the insert 18.

Generally, the position of the shoulder 14 is determined so that upon receipt of the seat trunnion 4 therein, the seat member 2 and trunnion mounting flange 3 are spaced above the upper edge 7 of the tubular member 6 so the edge 7 is not subjected to wear upon rotation of the seat member 2. Furthermore, shoulder 14 is prepared by machining the inner walls of the tubular member to a preselected diameter and depth sufficient to receive the trunnin 4 therein and to a preselected vertical position so as to receive the trunnion 4 and insert 18 thereon as discussed previously.

The tubular member 6 is provided with a plurality of seat height adjusting apertures 20*a* and 20*b*, each pair of apertures 20*a* and 20*b* being in alignment and disposed for alignment with an aligned pair of slots 24*a* and 24*b* cut into the upper edge of the vertically extending tube 9. The aligned apertures 20*a* and 20*b* with slots 24*a* and 24*b* are disposed to receive a height adjustment pin 22 therethrough, the alignment of the predetermined pair of apertures 20*a* and 20*b* with slots 24*a* and 24*b* determining the height of the seat member 2.

It will be realized that various changes may be made to the specific embodiment shown and described without departing from the principles of the present invention.

What is claimed is:

1. An adjustable seat comprising:

mounting means secured to a wall;

a first vertically extending tubular member mounted to said mounting means; a second vertically extending tubular member telescopically received by said first vertically extending tubular member with means thereon for adjusting the height of said second tubular member, said second tubular member having a socket therein, said socket being defined by upper inner walls of said second tubular with an inwardly extending shoulder portion at a preselected position therein;

a substantially flat disc cylindrical trunnion bearing insert resting upon said shoulder;

a vertically extending seat trunnion received by said second tubular member and extending upwardly beyond the upper extremity of said second tubular member defining a spacing between the upper extremities of said trunnion and said second tubular member, said trunnion resting upon said insert and disposed for rotational movement thereon; and, a seat member attached to said trunnion whereby said seat member is spaced above said second tubular member.

2. The adjustable seat of claim 1, said wall is an inner wall of a locomotive cab.

3. The adjustable seat of claim 1, said seat trunnion having a groove therein, said second tubular member having a threaded aperture therein in alignment with said groove; and, a locking screw received by said threaded aperture and said groove.

4. The adjustable seat of claim 1, said second vertically extending tubular member being telescopically received by said first vertically extending tubular member wherein said second tubular member is provided with a plurality of pairs of aligned seat height adjusting apertures therein on opposed sides of said second tubular member; said first tubular member being provided with a pair of slots disposed on opposed sides to align with a preselected pair of said aligned seat height adjusting apertures; and, a height adjustment pin received by said aligned apertures of said first tubular member and said second tubular member.

5. The adjustable seat of claim 1, said trunnion being provided with a plurality of aligned apertures therearound; said second tubular member being provided with an aperture therein alignable with said apertures of said trunnion; and, a locking pin received by one of said trunnion apertures and said second tubular member aperture.

* * * * *